US010752997B2

(12) United States Patent
Jiang et al.

(10) Patent No.: US 10,752,997 B2
(45) Date of Patent: Aug. 25, 2020

(54) METHODS AND APPARATUS FOR MAKING COATINGS USING ULTRASONIC SPRAY DEPOSITION

(75) Inventors: Wenping Jiang, Fayetteville, AR (US); Justin B. Lowrey, Fayetteville, AR (US); Robert T. Fink, Fayetteville, AR (US)

(73) Assignee: P&S Global Holdings LLC, Houston, TX (US)

( * ) Notice: Subject to any disclaimer, the term of this patent is extended or adjusted under 35 U.S.C. 154(b) by 930 days.

(21) Appl. No.: 12/446,048

(22) PCT Filed: Oct. 18, 2007

(86) PCT No.: PCT/US2007/022221

§ 371 (c)(1),
(2), (4) Date: Oct. 26, 2010

(87) PCT Pub. No.: WO2008/051434

PCT Pub. Date: May 2, 2008

(65) Prior Publication Data

US 2011/0033609 A1 Feb. 10, 2011

Related U.S. Application Data

(60) Provisional application No. 60/852,863, filed on Oct. 19, 2006.

(51) Int. Cl.
*B05D 3/06* (2006.01)
*C23C 24/08* (2006.01)

(52) U.S. Cl.
CPC ..... *C23C 24/08* (2013.01)

(58) Field of Classification Search
CPC ..... B05D 3/06; B05D 3/10
(Continued)

(56) References Cited

U.S. PATENT DOCUMENTS 4,031,278 A 6/1977 Patel
4,105,571 A 8/1978 Shaub et al.
(Continued)

FOREIGN PATENT DOCUMENTS

JP 60153113 8/1985
JP 03274283 12/1991
(Continued)

OTHER PUBLICATIONS

Zhi et al., SnO2 Nanoparticle-Functionalized Boron Nitride Nanotubes, Published on Web Apr. 12, 2006, J. Phys. Chem. B 2006, 110, 8548-8550.*

(Continued)

*Primary Examiner* — Hai Y Zhang
(74) *Attorney, Agent, or Firm* — Robert Devin Ricci; Richard Lee Vail; Kean Miller LLP

(57) ABSTRACT

Ultrasonic spray deposition (USD) used to deposit a base layer on the substrate, followed by chemical vapor infiltration (CVI) to introduce a binder phase that creates a composite coating with good adherence of the binder to the initial phase particles and adherence of the composite coating to the substrate, is disclosed. We have used this process to create coatings consisting of cubic boron nitride (cBN), deposited using USD, and titanium nitride (TiN) applied using CVI in various embodiments. This process can be used with many materials not usable with other processes, including nitrides, carbides, carbonitrides, borides, oxides, sulphides and silicides. In addition, other binding or post-deposition treatment processes can be applied as alternatives to CVI, depending on the substrate, the coating materials, and the application requirements of the coating. Coatings can be applied to a variety of substrates including those with complex geometries. The application also describes appa-
(Continued)

ratus or equipment designs used to perform ultrasonic spray deposition.

24 Claims, 7 Drawing Sheets

(58) Field of Classification Search
USPC ..... 427/2.26; 118/729, 730
See application file for complete search history.

(56) References Cited

U.S. PATENT DOCUMENTS 4,168,241 A 9/1979 Kozima et al.
4,334,928 A 6/1982 Hara et al.
4,485,759 A * 12/1984 Brandolf ..... B05B 13/0242 118/500
4,715,972 A 12/1987 Pacholke
4,745,010 A 5/1988 Sarin et al.
4,842,893 A * 6/1989 Yializis et al. ..... 427/497
4,877,677 A 10/1989 Hirochi et al.
4,940,521 A * 7/1990 Dinter ..... B29C 59/12 118/620
5,097,800 A 3/1992 Shaw et al.
5,102,592 A 4/1992 McCauley et al.
5,129,918 A 7/1992 Chattopadhay
5,273,790 A 12/1993 Herb et al.
5,286,565 A 2/1994 Holzl et al.
5,328,875 A 7/1994 Ueda et al.
5,330,854 A 7/1994 Singh et al.
5,363,821 A 11/1994 Rao et al.
5,389,118 A 2/1995 Hinterman et al.
5,391,422 A 2/1995 Omori et al.
5,407,464 A 4/1995 Kaliski
5,441,762 A 8/1995 Gray et al.
5,451,260 A 9/1995 Versteeg et al.
5,466,642 A 11/1995 Tajima et al.
5,500,331 A 3/1996 Czekai et al.
5,503,913 A 4/1996 Konig et al.
5,534,808 A 7/1996 Takaki et al.
5,614,140 A 3/1997 Pinneo
5,677,060 A 10/1997 Terentieva et al.
5,679,399 A 10/1997 Shlenker et al.
5,687,905 A * 11/1997 Tsai ..... B05B 7/067 239/4
5,704,556 A 1/1998 McLaughlin
5,733,609 A 3/1998 Wang
5,766,783 A 6/1998 Utsumi et al.
5,800,866 A 9/1998 Myers et al.
5,830,813 A 11/1998 Yao et al.
5,834,689 A 11/1998 Cook
5,882,777 A 3/1999 Kukino et al.
5,889,219 A 3/1999 Moriguchi et al.
5,897,751 A 4/1999 Makowiccki et al.
5,902,671 A 5/1999 Kutscher
5,928,771 A 7/1999 DeWald, Jr. et al.
5,945,166 A 8/1999 Singh et al.
5,985,356 A 11/1999 Schultz et al.
6,004,617 A 12/1999 Schultz et al.
6,196,910 B1 3/2001 Johnson et al.
6,217,843 B1 4/2001 Homyonfer et al.
6,240,873 B1 6/2001 Bertellotti et al.
6,258,139 B1 7/2001 Jensen
6,258,237 B1 7/2001 Gal-Or et al.
6,346,290 B1 2/2002 Schultz et al.
6,368,665 B1 4/2002 Hunt et al.
6,372,012 B1 4/2002 Majagi et al.
6,410,086 B1 6/2002 Brandon et al.
6,450,393 B1 * 9/2002 Doumanidis ..... B29C 64/147 228/110.1
6,484,826 B1 11/2002 Anderson et al.
6,540,800 B2 4/2003 Sherman et al.
6,544,599 B1 4/2003 Brown et al.
6,607,782 B1 * 8/2003 Malshe et al. ..... 427/189
6,756,119 B1 6/2004 Clough
6,852,948 B1 2/2005 Harrison
6,861,088 B2 3/2005 Weber et al.
6,864,201 B2 3/2005 Schultz et al.
6,933,049 B2 8/2005 Wan et al.
6,933,263 B2 8/2005 Manka et al.
6,962,895 B2 11/2005 Scharf et al.
7,018,606 B2 3/2006 Tenne et al.
7,018,958 B2 3/2006 Arrowsmith et al.
7,022,653 B2 4/2006 Hartley et al.
7,034,091 B2 4/2006 Schultz et al.
7,052,532 B1 5/2006 Liu et al.
7,060,319 B2 6/2006 Fredrickson
7,247,346 B1 7/2007 Sager et al.
7,250,195 B1 7/2007 Storey et al.
7,442,665 B2 10/2008 Schultz et al.
2002/0086189 A1 7/2002 Pham et al.
2002/0176989 A1 11/2002 Knudsen et al.
2003/0003237 A1 1/2003 Seabaugh et al.
2003/0025014 A1 2/2003 Sun et al.
2003/0162179 A1 8/2003 Potyrailo et al.
2003/0219544 A1 11/2003 Smith et al.
2004/0018238 A1 1/2004 Shukla
2004/0038808 A1 2/2004 Hampden-Smith et al.
2004/0228963 A1 11/2004 Bergh et al.
2005/0064088 A1 3/2005 Fredrickson
2005/0072266 A1 * 4/2005 Zaech ..... C23C 14/505 74/640
2005/0079200 A1 4/2005 Rathenow et al.
2005/0123759 A1 6/2005 Weinberg et al.
2005/0233062 A1 10/2005 Hossainy et al.
2005/0244644 A1 11/2005 Hampden-Smith et al.
2005/0260455 A1 * 11/2005 Xin et al. ..... 428/702
2006/0008589 A1 * 1/2006 Lin ..... 427/421.1
2006/0120947 A1 6/2006 Tenne et al.
2006/0144335 A1 7/2006 Lee et al.
2006/0177573 A1 8/2006 Pui et al.
2006/0193890 A1 8/2006 Owens et al.
2006/0198940 A1 9/2006 McMorrow
2006/0198941 A1 9/2006 Behan et al.
2006/0198942 A1 9/2006 O'Connor et al.
2006/0199013 A1 9/2006 Malshe et al.
2006/0219294 A1 10/2006 Yabuuchi et al.
2006/0275542 A1 12/2006 Mehta et al.
2007/0003749 A1 1/2007 Asgari
2007/0004884 A1 1/2007 Bildstein
2007/0057138 A1 * 3/2007 Esser ..... C23C 14/505 248/349.1
2007/0065668 A1 3/2007 Idei
2007/0154634 A1 7/2007 Renn
2007/0224239 A1 9/2007 Behan et al.
2008/0029625 A1 2/2008 Talton
2008/0050450 A1 2/2008 Arnold et al.
2008/0066375 A1 3/2008 Roos et al.
2008/0166493 A1 7/2008 Xiao et al.
2008/0280141 A1 11/2008 Dobbs et al.
2008/0305259 A1 12/2008 Saijo
2008/0311306 A1 12/2008 Xiao et al.
2008/0312111 A1 12/2008 Malshe et al.
2009/0014062 A1 * 1/2009 Kayama ..... H01G 9/2031 136/256

FOREIGN PATENT DOCUMENTS

JP 4290578 10/1992
JP 6297429 10/1994
JP 2004267893 9/2004
JP 2005307277 11/2005
JP 2006231169 9/2006
WO 0039358 7/2000
WO WO 2005071704 A2 * 8/2005 ..... H01G 9/20

OTHER PUBLICATIONS

Nguyen, H.Q. et al., "Nano-enamel: a new way to produce glass-like protective coatings for metals," Materials and Corrosion 53, 772-782 (2002).

(56) References Cited

OTHER PUBLICATIONS

European Search Report for EP07852841 (dated May 30, 2014).

* cited by examiner

1. Spray Nozzle Assembly
2. Coating Chamber
3. Stage Suspension
4. Coating Stage
5. Powder Recycling Collector

METHODS AND APPARATUS FOR MAKING COATINGS USING ULTRASONIC SPRAY DEPOSITION

This application is the National Stage of International Application No. PCT/US2007/022221, filed 18 Oct. 2007, which claims the benefit of U.S. Provisional Application No. 60/852,863, entitled "Methods and Apparatus for Making Coatings Using Ultrasonic Spray Deposition," and filed on Oct. 19, 2006, both of which are incorporated herein by reference.

BACKGROUND OF THE INVENTION

The present invention relates to methods and apparatus for making coatings and articles from various material compositions involving use of ultrasonic spray as the core method of coating deposition. Ultrasonic spray deposition produces coatings that are more dense, more uniform, and thinner than coatings produced using other methods. These coatings may be used for a variety of applications, including for example coatings for cutting tools where toughness and wear resistance are important and thing coatings are necessary, coatings for biomedical implants, and other applications where thin and uniform coatings are needed.

SUMMARY OF THE INVENTION

In one embodiment of the present invention, ultrasonic spray deposition (USD) is used to deposit a base layer on the substrate, followed by chemical vapor infiltration (CVI) to introduce a binder phase that creates a composite coating with good adherence of the binder to the initial phase particles and adherence of the composite coating to the substrate. U.S. Pat. No. 6,607,782 issued Aug. 19, 2003 to Ajay P. Malshe, et al., disclosed a method that used electrostatic spray coating (ESC) to deposit the initial base layer, followed by CVI as the second step. The present invention, which uses USD followed by CVI as one embodiment, provides important advantages over the previously disclosed method, including:

- Ability to produce more dense when the particles are dispersed in a liquid and sprayed using USD, with subsequent evaporation of the liquid, we have found that a much higher density of particles can be deposited on the substrate as compared to dry powder ESC;
- Greater uniformity and reduced surface roughness of the coatings—because nanoparticles dispersed in a properly-chosen liquid have a much reduced tendency to agglomerate, and because the USD process creates very small droplets of liquid dispersion that evaporate quickly during and following deposition, we found that the resulting coating exhibits much less agglomeration, and thus surface smoothness and uniformity of the coating are greatly enhanced;
- Ability to deposit thinner uniform coatings—with dry powder ESC, the minimum coating thickness tends to be in the range of 10 microns, while USD can produce uniform coatings that are as thin as one micron; and
- Ability to coat substrates that are not conductive (ESC requires that the surface of the substrate have a certain level of electrical conductivity—USD does not).

We have used this process to create coatings consisting of cubic boron nitride (cBN), deposited using USD, and titanium nitride (TiN) applied using CVI in various embodiments. This process can be used with many materials not usable with other processes, including nitrides, carbides, carbonitrides, borides, oxides, sulphides and silicides.

In addition, other binding or post-deposition treatment processes can be applied as alternatives to CVI, depending on the substrate, the coating materials, and the application requirements of the coating, in various embodiments. This invention is directed in various embodiments to multiple methods for creating coatings, comprised of a single material or multiple materials in combination, using USD as the process for initial deposition of a base or green coating. Coatings can be applied to a variety of substrates including those with complex geometries. The application also describes apparatus or equipment designs used to perform ultrasonic spray deposition.

DETAILED DESCRIPTION OF THE PREFERRED EMBODIMENTS

Disclosed herein are methods and apparatus for producing a coating on a substrate, beginning with ultrasonic spray deposition to deposit a base coating layer.

Two-Step Coating Processes—Overview

Figure 1:
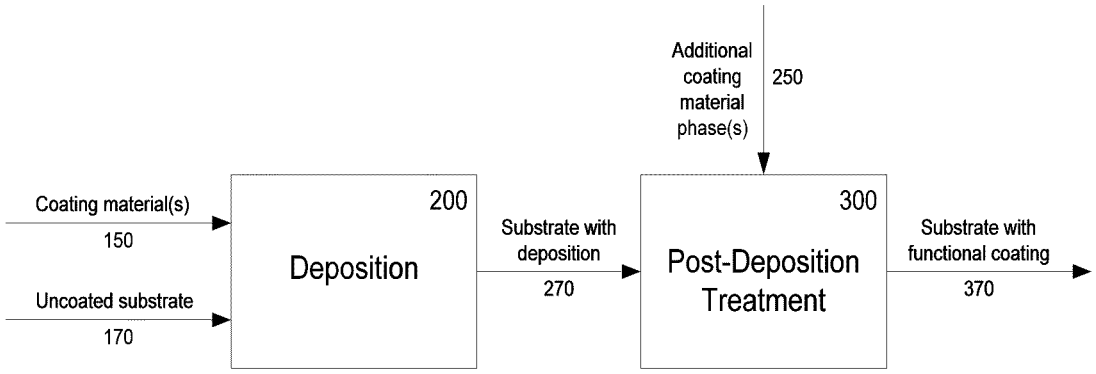
FIG. 1 illustrates the two-step coating process according to a preferred embodiment of the present invention, including an initial deposition of a base- or green-coating layer, followed by a post-deposition treatment step.

FIG. 1 illustrates a two-step process for producing a coating on a substrate. The substrate 170 is placed in a deposition system 200. One or more coating materials 150 are introduced into the deposition system 200. These coating materials may be in dry powder or liquid suspension form, and may contain nano- or micro-sized particles or a combination of the two. Multiple materials may be combined together or introduced separately into the deposition system 200. A variety of materials can be used, including nitrides, carbides, carbonitrides, borides, oxides, sulphides and silicides.

The deposition system 200 may use any of several methods to produce an initial coating or base layer on the substrate. One such deposition method is ultrasonic spray deposition (USD), described further below.

After the initial deposition step, dry solid particles of the coating material(s) are in contact with the substrate. The substrate with deposition 270 is the output of the deposition step 200 as illustrated in FIG. 1.

The substrate 270 with deposition of a base layer then undergoes a post-deposition treatment step 300. Post-deposition treatment is used to bind the deposited dry particles to one another and to the substrate. Suitable treatment methods include:

- Chemical vapor infiltration (CVI), which is similar to chemical vapor deposition (CVD) but using a slower reaction rate such that the binder infiltrates the porous dry powder deposition, coming into contact with both the substrate and the dry particles
- Sintering, using any of several alternative sintering methods, singly or in combination, including:
  - Microwave sintering
  - Laser sintering
  - Infrared sintering Each of these methods applies one or more short bursts of high energy (microwave, laser, infrared, or high temperature and high pressure) to sinter the particles of the initial coating deposition, binding them to each other and to the substrate. These methods can allow binding of the green coating to the substrate with less exposure of the substrate to high temperatures for long periods of time.

Another binding method is use of high temperature-high pressure (HT-HP), a process that is currently used for a variety of purposes including fabrication of polycrystalline cubic boron nitride (PCBN) solid compacts. In this invention, HT-HP is used as a post-deposition binding step to bind the deposited particles to each other and to the substrate.

In some embodiments, an additional treatment step (not shown in the figures) is applied after the post-deposition treatment step 300, to add an additional phase to the coating. One example of this is the use of electrostatic spray coating or ultrasonic spray deposition as a final step, after deposition and sintering of a base coating, for the purpose of applying active biological agents to the base coating. As a more specific example, a dental implant or other biomedical device, possibly with a porous surface layer, can be coated using ESC or USD followed by microwave sintering of the base coating. Then in an additional post-sintering deposition step, an active agent can be applied, such as a biocidal or anti-bacterial agent, other active agents such as bone-morphogenic proteins, or particles carrying drugs for drug delivery at the surface of the device after implantation. These are just examples of how a post-processing step can be used to apply additional components to a base coating for specific purposes.

Other additional treatment steps (not shown in the figures) that can be applied after post-deposition treatment 300 can be used to enhance the binding of the coating and to reduce or eliminate defects and non-uniformities in the coating. For example, suitable treatments for hard coatings such as those used for cutting tools include high temperature-high pressure (HT-HP) and infrared sintering (pulsed infrared radiation). Other methods using transient energy sources also may be used to enhance the characteristics of the final coating on the substrate.

Figure 2:
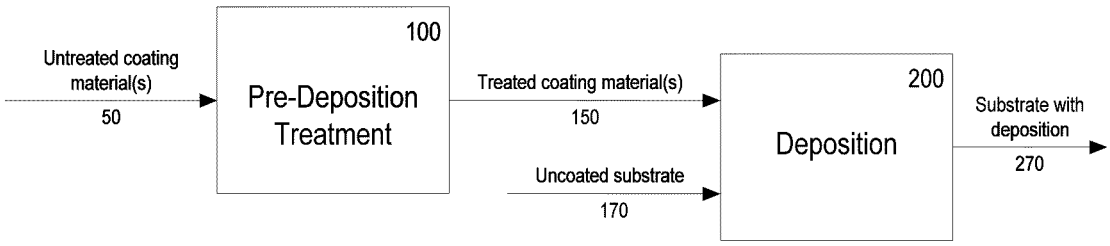
FIG. 2 shows the case in which a pre-deposition treatment is applied to the coating materials prior to deposition.

As shown in FIG. 2, some embodiments of the invention include an optional pre-deposition treatment step 100. Untreated coating materials 50 are treated prior to being passed as treated coating materials 150 to the deposition system 200. For example, particles of coating material may be pre-treated for the purpose of functionalization (providing specific functionality desired for a specific application), or over-coating of particles for any of a number of purposes (e.g., protection of particles from high temperatures involved in the coating process).

Methods and Apparatus for Coating Deposition

Figure 3:
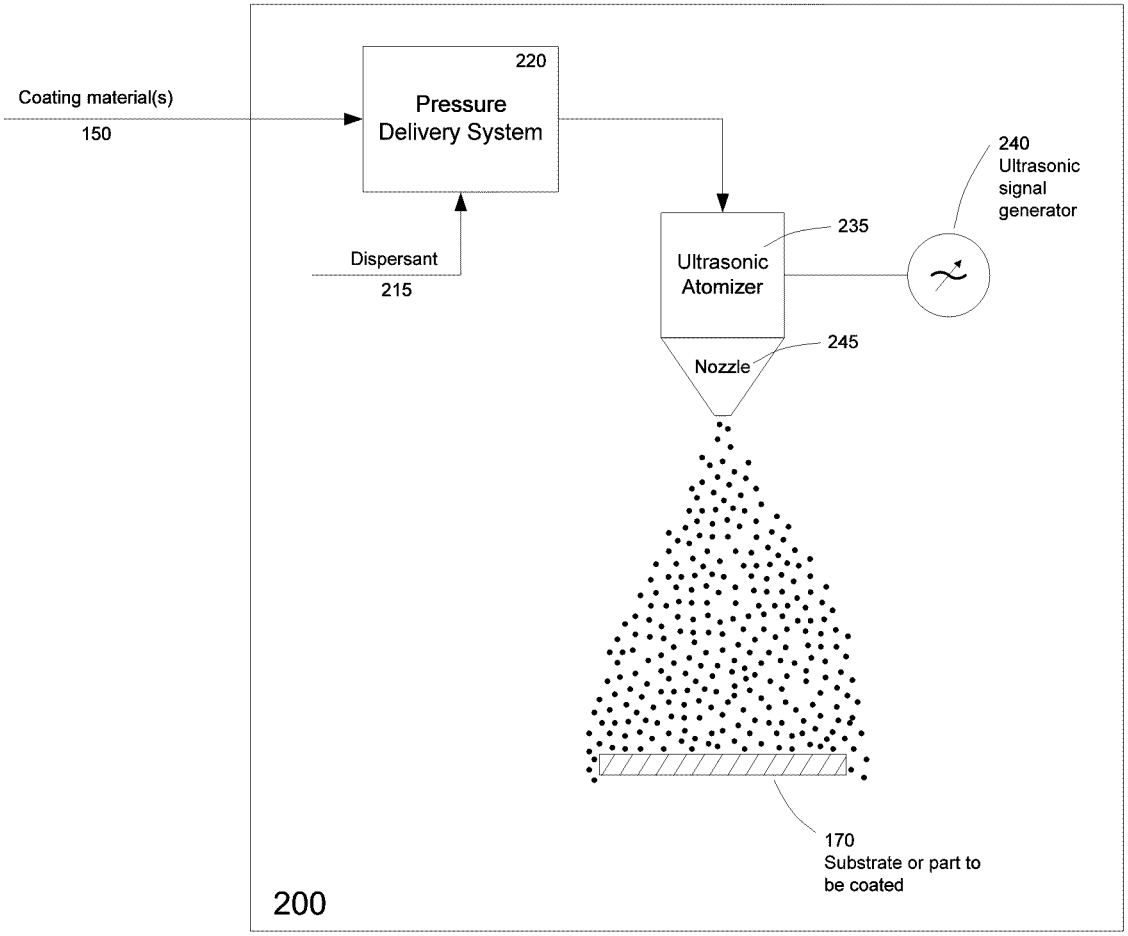
FIG. 3 illustrates an ultrasonic spray deposition process.

FIG. 3 illustrates a method of deposition 200 that uses ultrasonic atomization and spray of a liquid dispersion to deposit materials on a substrate. Coating materials 150, which may optionally have been pre-treated as discussed above, are introduced to a pressure delivery system 220. A dispersant 215 also is introduced to the pressure delivery system, in which the coating materials are dispersed in the liquid dispersant. The pressure delivery system 220 maintains the materials in dispersion and pressurizes the dispersion, feeding it to an ultrasonic atomizer 235.

The liquid used to create the dispersion can be chosen from among a number of suitable candidates, including methanol, ethanol, and the like. For ultrasonic spray of cubic boron nitride (cBN), we have used ethanol ($C_2H_5OH$) as the liquid. Ethanol has hydrophilic molecules or polar molecules, which helps to attach cBN particles with hygroscopic characteristics and to keep the particles suspended in the liquid. Other dispersants that are of polar characteristics can also be applied, or applied in combination with surfactants for further uniform dispersion.

An ultrasonic signal generator 240 is connected to a piezoelectric element within the atomizer 235. The piezoelectric element converts the ultrasonic signal into mechanical action that atomizes the liquid dispersion into droplets, which are fed to a nozzle 245. By adjusting the frequency of the ultrasonic signal, the size of the resulting droplets can be adjusted. Higher frequencies produce smaller droplets. For example, in one embodiment a frequency of 125 KHz is used, which produces droplets that have a median size of about 20 microns.

The nozzle directs the droplets toward the substrate or part to be coated, 170. The liquid in the droplets evaporates, either in transit toward the substrate or after deposition on the substrate or a combination of the two. The result is a dry powder deposition of coating material(s) on the substrate. As an option, a gas flow (using air, nitrogen, or other suitable gas) may be introduced around the exit of the nozzle to further direct the droplet spray toward the surface. This can improve the speed of deposition as well as increase the efficiency of material deposition (fraction of material that is deposited on the substrate). The gas may be heated to speed up evaporation of the liquid.

Ultrasonic spray deposition (USD) offers several advantages over electrostatic spray coating (ESC) that make USD more suitable for some applications. Compared to ESC, USD can be used to create thinner coatings. Also, because the coating material is dispersed in a liquid that tends to de-agglomerate the material, and the ultrasonic atomization process itself tends to break up agglomerates, the resulting deposition is more uniform with a smoother surface. We also have found that we are able to create higher density coatings with USD, i.e., the volumetric fraction of coating material in the coating preform can be made higher with USD than with ESC.

Figure 4:
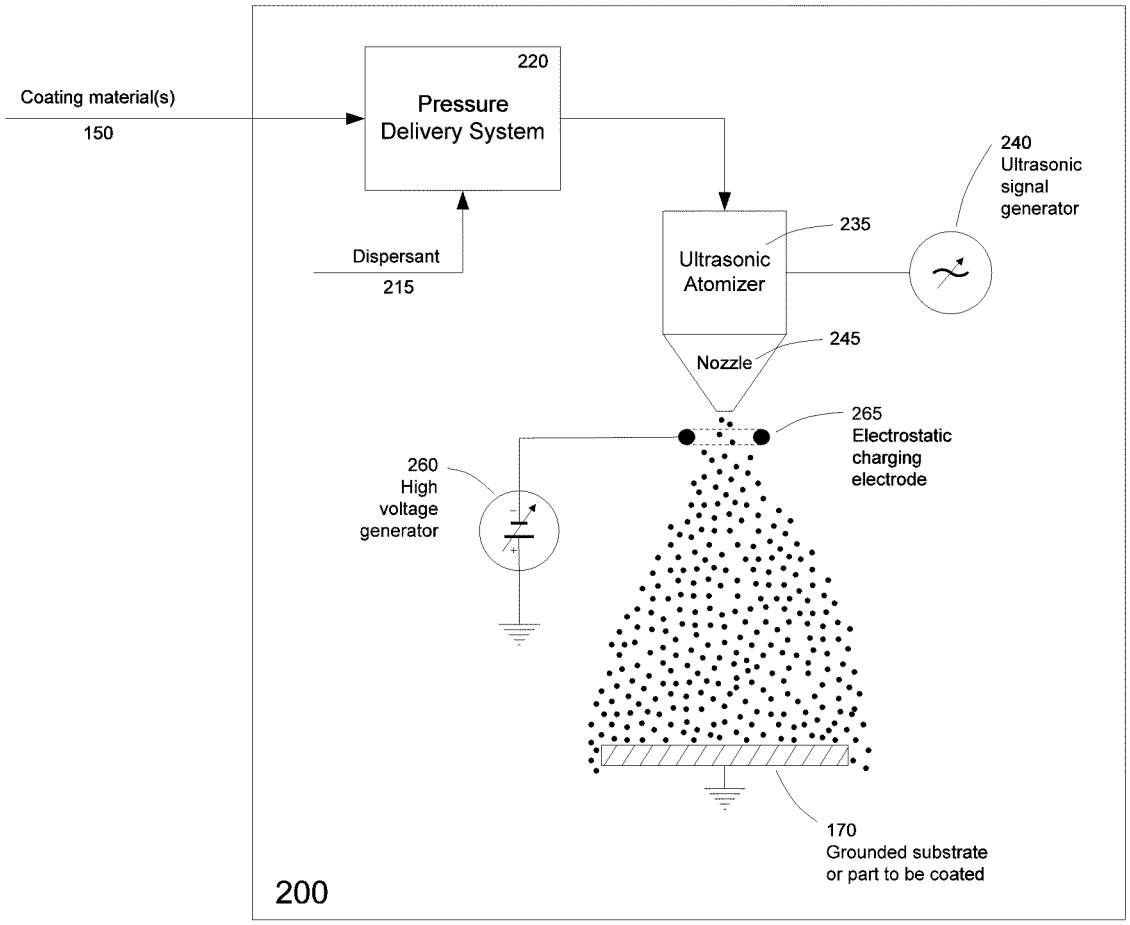
FIG. 4 shows ultrasonic spray deposition in combination with electrostatic charging.

FIG. 4 illustrates yet another method of deposition 200 that combines ultrasonic spray deposition with electrostatic charging. Again, coating materials 150 (untreated or pre-treated) and a liquid dispersant 215 are introduced to a pressure delivery system 220. The combination of the ultrasonic atomizer 235, ultrasonic signal generator 240, and nozzle 245 create a spray with droplets of controlled size that are directed toward the substrate 170. As discussed previously, a gas flow also may be introduced to further direct the droplet spray and increase speed and efficiency of deposition.

In this embodiment, the droplets are given an electrostatic charge by positioning one or more conducting electrodes 265 near the exit of the ultrasonic spray nozzle 245. By applying a high voltage to the electrode(s), using an adjustable high voltage generator 260, and grounding the substrate 170 (the substrate must have a surface with a certain conductivity), the droplets exiting the ultrasonic nozzle are charged and follow the electric field lines to the substrate. A variety of shapes and configurations can be used for the electrode, including a circular or elliptical collar, as well as one or more point electrodes arranged near the nozzle exit.

By adjusting the positioning of the nozzle 245, electrode 265 and substrate 170 and adjusting the voltage, electrode-substrate distance, ultrasonic frequency (influencing droplet size) and spray pressure from the pressure delivery system 220, the balance between electrostatic influence and the ultrasonic spray of the droplets can be altered to provide the characteristics needed for a given coating application. Adjusting the voltage level and the distance between the spray nozzle and the substrate can modify the transit time for droplets between nozzle and substrate. As an option, the carrier gas can be heated, affecting the rate at which droplets evaporate during transit. These various adjustments can be used to optimize the process such that the desired balance is achieved between dry deposition (droplets have evaporated prior to reaching the substrate) and wet deposition (droplets are still liquid when they deposit on the surface), allowing all dry, all wet, or hybrid wet/dry deposition to be used depending on what is best for the application.

This approach combines the positive aspects of both ultrasonic spray deposition (USD) and electrostatic charging, which provides several advantages:

- Addition of electrostatic forces to the USD process can help coat 3D surfaces conformally, placing less reliance on line of sight between nozzle and substrate surface;
- Addition of electrostatic forces improves the deposition rate compared to USD alone;
- Electrostatic forces also increase transfer efficiency (fraction of material sprayed that is deposited on the substrate), which increases productivity of deposition and reduces potential environmental effects of undeposited material;
- Electrostatic forces improve coverage of sharp edges, because the electric field lines tend to converge at the edges causing greater buildup of droplets/particles there; and
- Compared to electrostatic spray coating (ESC) alone (see U.S. Pat. No. 6,544,599, incorporated herein by reference), combining USD and electrostatic charging provides several of the advantages noted above for ultrasonic spray, namely the ability to create thinner, more dense and more uniform coatings.

Figure 5:
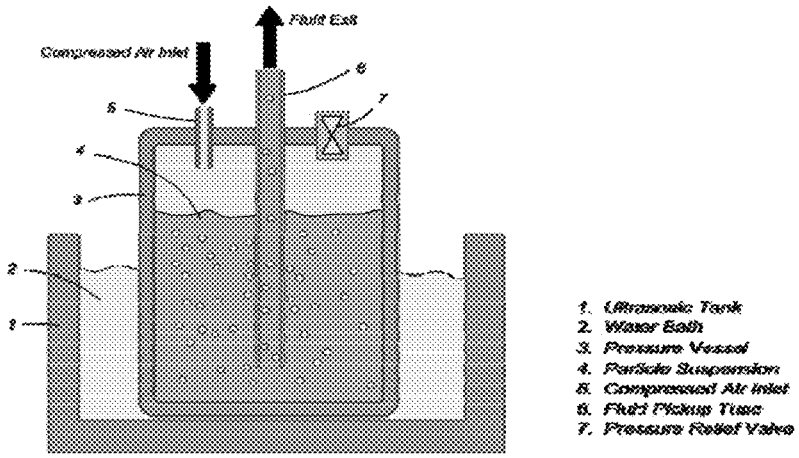
FIG. 5 illustrates an ultrasonic tank used in feeding coating materials dispersed in a liquid to the ultrasonic deposition system.

A key part of the pressure delivery system for ultrasonic spray deposition is an ultrasonic tank, which maintains a suspension of particles within a dispersant for delivery to the ultrasonic spray system. FIG. 5 illustrates the ultrasonic tank apparatus. A pressure vessel (3) stores the particle suspension (4). An opening with suitable pressure seal (not shown in the figure) is used for initially filling the vessel manually. The vessel also can be filled automatically by providing appropriate feed lines/inlets for liquid dispersant and powder particles, along with suitable metering and automatic controls.

The vessel is pressurized using compressed air, nitrogen or other suitable gas under pressure, which enters the vessel at the compressed air inlet (5). For some applications, maintaining control of the humidity level or dew point of the gas may be required. As an option, the gas can be pre-heated to speed up the removal of the dispersant in the course of deposition. A pressure relief valve (7) is provided as a safety measure to prevent the vessel or other parts of the pressurized assembly from being over-pressurized and potentially leaking or rupturing.

The particle suspension exits the pressure vessel through a fluid pickup tube (6). The distance between the bottom of the fluid pickup tube and the bottom of the pressure vessel can be adjusted to ensure that fluid is drawn from a location within the pressure vessel that has consistent particle density and good suspension. Liquid level indication (not shown in the figure) is provided external to the pressure vessel.

As an option, the ultrasonic tank can employ any of a variety of means for maintaining a uniform dispersion of the particles. For example, in one embodiment shown in the figure, a commercial ultrasonic water bath (1) is used to surround the pressure vessel with sonicated water (2), which imparts ultrasonic vibrations to the pressure vessel and the suspension within. Other examples include use of mechanical vibrators attached to a surrounding bath or to the pressure vessel, an ultrasonic vibrator stick or similar device immersed in the suspension inside the vessel, mechanical stirrers, and other vibration or sonication means.

Figure 6:
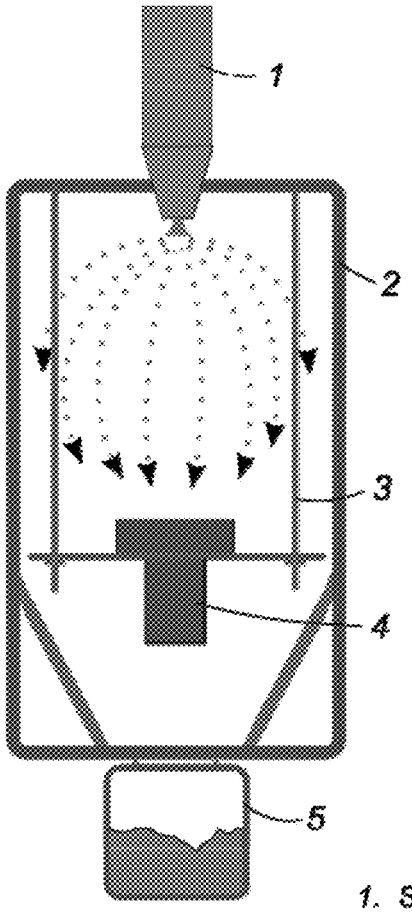
FIG. 6 shows the deposition chamber used to contain the materials being deposited, preventing unacceptable release to the environment, allow for adjustment of spray nozzle to substrate distance, and capture and recycle unused coating materials.

FIG. 6 illustrates a deposition chamber that can be used for electrostatic spray coating (ESC), ultrasonic spray deposition (USD), or USD plus electrostatic charging. A spray nozzle assembly (1) is mounted such that it sprays coating material (dry powder or liquid suspension containing particles) into the coating chamber (2). The spray nozzle assembly may employ electrostatic, ultrasonic, or ultrasonic plus electrostatic deposition means. The substrate(s) or part(s) to be coated are placed on a stage (4) that is suspended in the chamber using a stage suspension assembly (3). The orientation of the stage may be fixed or, as an option, a rotating stage may be used as described further herein. The distance between the stage and the spray nozzle can be adjusted.

The chamber is sealed so as to prevent egress of the coating material or ingress of contaminants. Material that is not deposited on the substrate(s) is collected in a powder recycling collector (5) so that material may be recycled. In the preferred embodiment, the unused material exits the sealed chamber via a liquid bath or by other filtering mean so that the material is captured for re-use and is prevented from being released to the environment.

In a preferred embodiment, the adjustments provided on the stage suspension assembly (3) are located external to the chamber by extending the assembly through the top of the chamber through openings that are sealed using O-ring type seals or other sealing means. With this design, adjustments in stage-to-nozzle distance can be made without opening the chamber.

Figure 7:
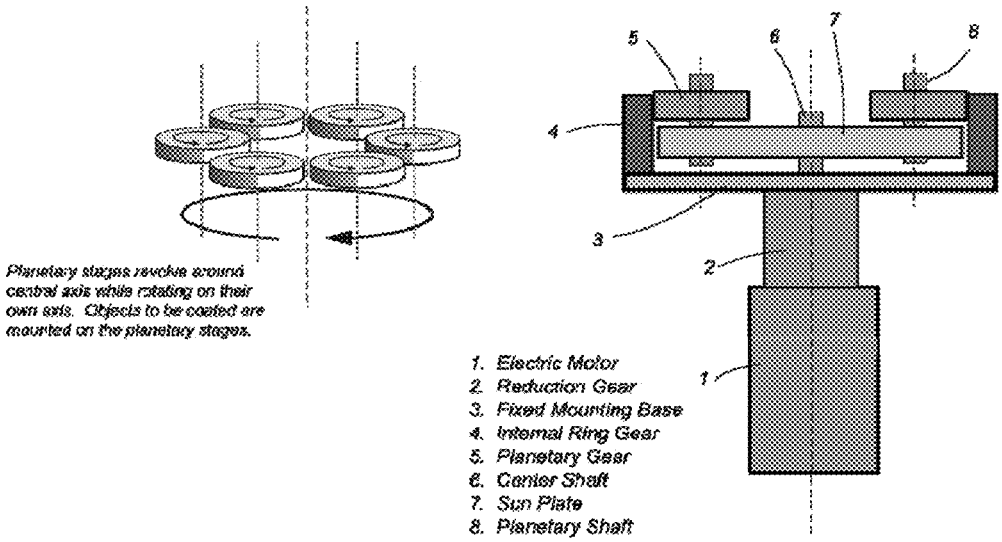
FIG. 7 illustrates a rotating stage used to ensure uniform deposition of the coating on the substrate.

FIG. 7 illustrates the rotating stage that is used as an option to improve uniformity of deposition across the surface of the substrate. The rotating stage can be used with electrostatic spray, ultrasonic spray, ultrasonic spray with electrostatic charging, and other deposition methods. An electric motor (1) drives the apparatus through a reduction gear (2), causing the center shaft (6) to rotate. A sun plate (7) is attached to the center shaft (6) and rotates with the shaft. A number of planetary gears (5) are mounted to the sun plate (7) using planetary shafts (8). The planetary gears mesh with an internal ring gear (4) that is mounted to the fixed mounting base (3). In one embodiment shown in the figure, six planetary gears are used.

As the sun plate rotates, the planetary gears move around the central axis of the assembly and, due to their interaction with the internal ring gear, the planetary gears also rotate on their own axes. Substrates are mounted on the individual planetary gear stages. The dual rotation action enhances the uniformity of the deposition on the substrate by ensuring that all points on the surface of the substrate are exposed equally to the material spray.

The planetary and ring gears can mesh using conventional gear teeth, or the planetary gears can be made as rollers that are pressed outward (e.g., by springs) such that the outer edge of each roller contacts the surface of the internal ring gear and friction causes the planetary gears to rotate.

For any type of electrostatic deposition, the planetary gears must be grounded in order to ground the substrate that is mounted on them. This requires that a means be provided to electrically connect the planetary gears to a grounded member. In one embodiment in which the planetary gears are rollers, the springs that press against the planetary gear shafts and hold the planetary gears against the internal ring gear also act as brushes to make an electrical connection between the planetary gears and the rest of the grounded rotating stage assembly.

The speed of the electric motor can be adjusted to ensure that the substrate to be coated is exposed to all parts of the deposition spray pattern equally in order to achieve the desired uniformity of coating. The speed can be adjusted by changing the power input (voltage) to the DC motor. In the specific embodiment shown in the figure, the ratio of the rotational speed of the planetary gears to that of the overall sun plate is fixed by the gear ratio. However, in alternative embodiments one or more additional motors or other means can be provided such that the two speeds can be adjusted independently.

The rotating stage also can be translated by mounting it on an appropriate platform that is moved laterally in either the x or the y direction, and the stage also can be translated in the z-axis direction (vertical direction in the figure), moving the rotating stage closer to or further away from the spray source.

Figure 8:
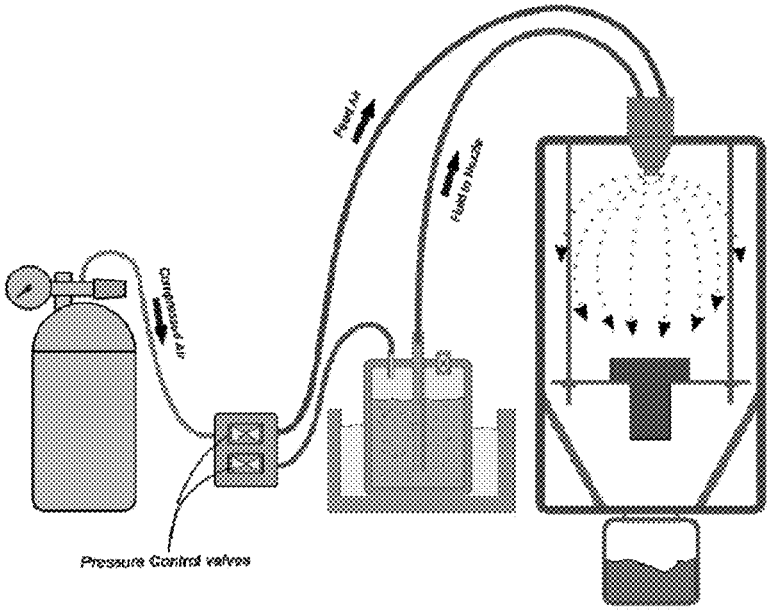
FIG. 8 shows the integrated ultrasonic spray deposition system including the ultrasonic pressure delivery system, and the deposition system including the chamber.

FIG. 8 illustrates an integrated ultrasonic spray deposition system. Compressed air, nitrogen or other suitable gas is provided to the pressure delivery system through pressure control valves. One of these valves controls the pressure of gas that is sent to the ultrasonic tank. A liquid suspension of particles exits the pressurized ultrasonic tank and is sent to the ultrasonic spray nozzle assembly. As an option, a second valve is used to control the pressure of gas that is fed to the ultrasonic spray nozzle assembly to further direct the ultrasonic spray to the substrate. The ultrasonic spray nozzle assembly is mounted to the deposition chamber, which is described separately herein.

The same arrangement is used for ultrasonic spray deposition with electrostatic charging. In that case, an electrode and adjustable voltage source are provided and the substrate is grounded to provide electric field-assisted ultrasonic deposition. A commercial high-voltage generator available for ESC systems can be used; however, we have found that some modification is required for this application, namely modifying the voltage generator so that it can be applied to dispersants that have widely different dielectric constants.

Other optional features that can be included in the system described here are:

Pre-heating of the carrier gas or liquid, when desired for specific applications;

Automation of the material feeds, gas and liquid dispersion flows, temperatures, and rotation/translation of the substrate, and automatic measurements of feed and deposition rates, temperatures and other key variables;

Additional translation (in the x, y and/or z directions) of the substrate or ultrasonic nozzle (with or without electrostatic charging) or both, to allow deposition on large surfaces; and Use of multiple nozzles to allow coating large surfaces or complex geometries.

We claim:

1. A method for coating a substrate with a powdered deposition material, comprising the steps of:

(a) dispersing the powdered deposition material within a liquid dispersant comprising a different composition than the powdered deposition material to form a liquid dispersion consisting of the powdered deposition material and the liquid dispersant, then atomizing the liquid dispersion by means of vibration induced energy;

(b) directing the liquid dispersion toward the substrate wherein the liquid dispersant evaporates while in route to the substrate such that the powdered deposition material forms a porous dry powder deposition on the substrate;

(c) directing a gas flow toward the substrate simultaneous to directing the liquid dispersion toward the substrate wherein the gas flow further directs the liquid dispersion toward the substrate; and (d) electrostatically charging the powdered deposition material grounding the substrate whereby the powdered deposition material is electrostatically drawn along electric field lines toward the substrate to improve coverage of the powdered deposition material on at the at least one sharp edge of the substrate;

whereas the liquid dispersant is an alcohol with polar characteristics and the powdered deposition material consist of boron nitride.

2. The method of claim 1, further comprising a step of applying a post-deposition treatment comprises one or more of chemical vapor infiltration and polishing.

3. The method of claim 2, wherein said step of chemical vapor infiltration comprises the step of applying titanium nitride to the substrate.

4. The method of claim 1, further comprising a step of applying an active biological agent on top of the porous dry powder deposition on the substrate.

5. The method of claim 4, wherein the active biological agent comprises one of a biocidal and anti-bacterial agent.

6. The method of claim 1, wherein said directing the liquid dispersion onto the substrate step utilizes a nozzle.

7. The method of claim 1, further comprising the step of heating the gas flow.

8. The method of claim 1, wherein the powdered deposition material comprises nano-sized particles.

9. The method of claim 1, further comprising the step of manipulating the substrate during said step of directing the liquid dispersion onto the substrate.

10. The method of claim 9, wherein said manipulating the substrate step comprises the step of rotating the substrate on a stage.

11. The method of claim 10, further comprising the step of translating the stage by moving the stage laterally in both an x-direction and a y-direction.

12. The method of claim 11, further comprising the step of translating the stage by moving the stage vertically in a z-direction.

13. The method of claim 11, wherein the step of translating the stage comprises the step of rotating a center shaft attached to a sun plate, which is interconnected with a plurality of planetary gears each mounted to a planetary gear shaft, wherein at least one of a plurality of substrates is mounted to each one of the plurality of planetary gears.

14. The method of claim 13, wherein the sun plate and planetary gear plates are interconnected by the rotation of an internal ring gear.

15. The method of claim 14, wherein the planetary gear and the internal ring gear mesh using conventional gear teeth.

16. The method of claim 14, wherein the planetary gears plates comprise rollers that are pressed outward such that an outer edge of each roller contacts the internal ring gear.

17. The method of claim 16, wherein each of the planetary gear plates are grounded through an electrical connection formed by electrically conductive springs that press the rollers outward to contact the internal ring gear.

18. The method of claim 14, wherein the planetary gear plates and the sun plate are moved at speeds that are adjusted independently of each other.

19. The method of claim 1, further comprising the step of treating the powdered deposition material prior to said step of atomizing the liquid dispersion.

20. The method of claim 19, wherein said treating the powdered deposition material step comprises the step of coating the powdered deposition material with at least one of a functionalization material and a protective material.

21. The method of claim 1, wherein the powdered deposition material is electrically non-conducting.

22. The method of claim 1, wherein the step of directing the liquid dispersion toward the substrate is performed by spraying the liquid dispersion through multiple nozzles to allow coatings on large surfaces or substrates with three-dimensional geometries.

23. The method of claim 1, further comprising a step of applying at least one of an in situ or post-deposition treatment to the substrate whereby the deposition material is bound to the substrate.

24. The method of claim 23, further comprising a step of directing an agent material to the substrate subsequent to the step of applying one of an in situ and post-deposition treatment.

* * * * *